US010959487B2

(12) United States Patent
Brown

(10) Patent No.: US 10,959,487 B2
(45) Date of Patent: Mar. 30, 2021

(54) QUICK CHANGE SHOCK MITIGATION OUTSOLE INSERT WITH ENERGY HARVESTER

(71) Applicant: B&B Technologies L.P., San Diego, CA (US)

(72) Inventor: Jeffrey W. Brown, San Diego, CA (US)

(73) Assignee: B&B TECHNOLOGIES L.P., San Diego, CA (US)

( * ) Notice: Subject to any disclaimer, the term of this patent is extended or adjusted under 35 U.S.C. 154(b) by 741 days.

(21) Appl. No.: 15/628,027

(22) Filed: Jun. 20, 2017

(65) Prior Publication Data

US 2017/0280824 A1 Oct. 5, 2017

Related U.S. Application Data

(63) Continuation-in-part of application No. 14/330,451, filed on Jul. 14, 2014, now abandoned.
(Continued)

(51) Int. Cl.
*A43B 13/18* (2006.01)
*A43B 21/30* (2006.01)
(Continued)

(52) U.S. Cl.
CPC ..... *A43B 13/182* (2013.01); *A43B 1/0054* (2013.01); *A43B 3/0015* (2013.01); *A43B 7/144* (2013.01); *A43B 7/1445* (2013.01); *A43B 7/1465* (2013.01); *A43B 21/00* (2013.01); *A43B 21/30* (2013.01); *A43B 21/24* (2013.01)

(58) Field of Classification Search
CPC ..... A43B 1/0054; A43B 7/1445; A43B 7/144; A43B 13/181; A43B 13/182; A43B 13/185; A43B 21/00
USPC ..... 36/102, 103, 105, 92, 37, 34 R, 28, 27, 36/7.8
See application file for complete search history.

(56) References Cited

U.S. PATENT DOCUMENTS

| | | | |
|---|---|---|---|
| 819,449 | A | 5/1906 | Otterstedt |
| 1,099,180 | A | 6/1914 | Karácsonyi |

(Continued)

FOREIGN PATENT DOCUMENTS

| | | |
|---|---|---|
| DE | 618719 | 9/1935 |
| GB | 664554 | 1/1952 |
| SU | 1161073 A | 6/1985 |

OTHER PUBLICATIONS

International Search Report Corresponding to PCT/US2018/038047 dated Oct. 4, 2018.

*Primary Examiner* — Jillian K Pierorazio
(74) *Attorney, Agent, or Firm* — Davis & Bujold PLLC; Michael J. Bujold

(57) ABSTRACT

A modular article of footwear has a shock absorbing insert placed between the insole and the outsole thereof, for example at the heel. The insert includes a spring carrier having upper and lower portions, each having a plurality seats for receiving a respective ends of respective coil springs. Each of the springs extends between said upper and lower portions and is captured therebetween. A pair of opposed permanent magnets generates a separating force which supplements the supporting force of the mechanical springs. The insert may also contain a device for converting mechanical energy to electrical energy.

16 Claims, 7 Drawing Sheets

Related U.S. Application Data

(60) Provisional application No. 61/957,910, filed on Jul. 15, 2013.

(51) Int. Cl.

| | |
|---|---|
| ***A43B 7/14*** | (2006.01) |
| ***A43B 1/00*** | (2006.01) |
| ***A43B 21/00*** | (2006.01) |
| ***A43B 3/00*** | (2006.01) |
| *A43B 21/24* | (2006.01) |

(56) References Cited

U.S. PATENT DOCUMENTS 1,218,391 A 3/1917 Gay
1,261,488 A 4/1918 Cerar et al.
1,506,975 A 9/1924 Cooney
2,004,906 A 6/1935 Simister
2,444,865 A * 7/1948 Warrington ..... A43B 21/30 36/36 R
2,555,654 A * 6/1951 Ostrom ..... A43B 21/30 36/38
2,669,038 A * 2/1954 De Werth ..... A43B 21/30 36/38
3,044,190 A 7/1962 Urbany
3,180,039 A 4/1965 Burns, Jr.
4,066,602 A 1/1978 Pellico
4,238,383 A 12/1980 Anderson
4,457,084 A 7/1984 Horibata et al.
4,520,138 A 5/1985 Himes
4,566,206 A 1/1986 Weber
4,592,153 A 6/1986 Jacinto
4,629,583 A 12/1986 Goguen
4,672,754 A 6/1987 Ehrlich
4,753,021 A 6/1988 Cohen
4,760,651 A 8/1988 Pon-Tzu
4,817,304 A 4/1989 Parker et al.
5,138,776 A 8/1992 Levin
5,311,674 A * 5/1994 Santiyanont ..... A43B 21/26 36/28
5,343,639 A * 9/1994 Kilgore ..... A43B 13/183 36/27
5,502,901 A * 4/1996 Brown ..... A43B 1/0018 36/27
5,544,431 A * 8/1996 Dixon ..... A43B 21/30 36/27
5,554,694 A 9/1996 Crow
5,649,374 A * 7/1997 Chou ..... A43B 21/30 36/27
5,695,850 A 12/1997 Crow
5,716,723 A 2/1998 Van Cleef et al.
5,743,028 A * 4/1998 Lombardino ..... A43B 13/182 36/27
5,832,629 A 11/1998 Wen
5,839,209 A * 11/1998 Healy ..... A43B 13/181 36/30 A
6,006,449 A * 12/1999 Orlowski ..... A43B 13/182 36/27
6,041,520 A 3/2000 Aoki
6,055,747 A * 5/2000 Lombardino ..... A43B 1/0072 36/27
6,239,501 B1 5/2001 Komarechka
6,282,814 B1 9/2001 Krafsur et al.
6,393,731 B1 * 5/2002 Moua ..... A43B 13/182 36/27
6,568,102 B1 * 5/2003 Healy ..... A43B 13/187 36/27
7,152,339 B2 * 12/2006 Lo ..... A43B 7/08 36/3 R
7,213,350 B2 5/2007 Brown
7,395,614 B1 7/2008 Bailey, Sr. et al.
7,814,683 B2 * 10/2010 Lee ..... A43B 13/026 36/25 R
2001/0005946 A1 * 7/2001 Brown ..... A43B 13/182 36/28
2002/0073579 A1 * 6/2002 Lombardino ..... A43B 13/182 36/28
2002/0189134 A1 * 12/2002 Dixon ..... A43B 5/00 36/27
2003/0110661 A1 * 6/2003 Wu ..... A43B 13/182 36/27
2004/0107602 A1 * 6/2004 Brown ..... A43B 13/182 36/28
2004/0128860 A1 * 7/2004 Smaldone ..... A43B 1/0072 36/28
2004/0194347 A1 * 10/2004 Aveni ..... A43B 7/1465 36/91
2005/0155254 A1 7/2005 Smith et al.
2005/0204584 A1 9/2005 Ryoo
2006/0096125 A1 * 5/2006 Yen ..... A43B 3/0063 36/35 B
2007/0294916 A1 * 12/2007 Park ..... A43B 13/182 36/29
2008/0189986 A1 * 8/2008 Elnekaveh ..... A43B 1/0054 36/102
2008/0263894 A1 * 10/2008 Nakano ..... A43B 13/181 36/28
2008/0313928 A1 * 12/2008 Adams ..... A63C 17/08 36/103
2009/0056165 A1 * 3/2009 Lee ..... A43B 13/026 36/88
2010/0095553 A1 * 4/2010 Elnekaveh ..... A43B 7/082 36/102
2010/0251574 A1 * 10/2010 Battlogg ..... A43B 5/0405 36/117.1
2012/0023784 A1 * 2/2012 Goldston ..... A43B 3/0031 36/137
2012/0110871 A1 * 5/2012 Elnekaveh ..... A43B 7/082 36/87
2012/0137541 A1 * 6/2012 Yeo ..... A43B 13/182 36/27
2012/0260522 A1 * 10/2012 Shi ..... A43B 1/0054 36/2.6
2012/0260531 A1 * 10/2012 Shi ..... A43B 3/0015 36/102
2013/0055593 A1 * 3/2013 Park ..... A43B 7/144 36/102
2015/0013191 A1 1/2015 Brown

* cited by examiner

QUICK CHANGE SHOCK MITIGATION OUTSOLE INSERT WITH ENERGY HARVESTER

This application is a continuation-in-part of application Ser. No. 14/330,451 filed Jul. 14, 2014, which claims benefit of provisional application 61/957,910, filed Jul. 15, 2013.

BACKGROUND OF THE INVENTION

This invention relates to shock absorbing footwear.

Numerous footwear inventions have been proposed for absorbing shock and adding lift, particularly in the athletic shoe field. For example, U.S. Pat. No. 4,817,304 describes footwear with a cushioning sole structure in which a sealed internal member in the sole is inflated with gas to form a resilient insert in the heel region of the shoe. Various shoe structures have also been proposed in which springs are embedded in the shoe sole in the heel region or over the entire sole. See, for example, U.S. Pat. Nos. 5,502,901, 5,138,776, 4,566,206, and 4,592,153. Some of these structures are bulky and heavy, or cannot effectively be manufactured. My own patents (U.S. Pat. Nos. 5,502,901 and 7,213,350) describe improvements over those prior patents.

One problem with prior shock absorbing footwear, including my own, is that the characteristics of the shock absorber, particularly including the load capacity, cannot be easily adjusted.

SUMMARY OF THE INVENTION

It is an object of the present invention to provide new and improved items of footwear which have improved shock absorbing properties and which also add lift and propulsion to the foot of a wearer when walking or running.

An object of the invention is to provide an article of footwear having an improved, easily replaceable, spring insert in the heel.

Another object is to generate electrical power within the footwear as the user walks or runs.

A further object is to provide a modular article of footwear, which can be quickly rebuilt, replaced, or modified by the wearer.

These and other objects are attained by a shock absorbing footwear as described below.

In this invention, a modular insert, containing two strong permanent magnets, is placed in a cavity in the heel of a shoe or boot. The magnets are arranged in magnetic opposition so that they are repelled from one another. The opposed magnets function as a magnetic spring, which acts in conjunction with mechanical (coil) springs to dissipate shock and add lift and propulsion to the wearer's foot in motion.

The insert snaps into the heel cavity, so that it can be easily and quickly replaced, for example, for wearers of different weights.

The coil springs and magnetic spring together are designed to support an air-flux gap within the sole member at all times. This permits continuous and more effective shock dissipation than when the gap is closed, solid or absent under load.

The coil springs and magnets work in conjunction to absorb and dissipate load or shock as the foot hits the ground. Subsequently, as the load shifts from the heel to the ball of the foot, both the coil springs and the magnets bias the opposing walls of the cavity apart, giving lift or propulsion to the wearer.

The footwear may also include electrical elements which convert and store some of the mechanical energy generated by walking, Which would otherwise be absorbed or dissipated, into useful electrical energy.

The shock absorbing insert of this invention may be used in any type of footwear, such as sports/athletic shoes, boots, casual shoes, work shoes, children's shoes, orthopedic shoes, sandals and the like. It significantly reduces shock to the body while walking, running or in other types of foot motion, and adds lift and propulsion, thereby reducing fatigue.

BRIEF DESCRIPTION OF THE DRAWINGS

In the accompanying drawings.

DESCRIPTION OF THE PREFERRED EMBODIMENT

Figure 1:
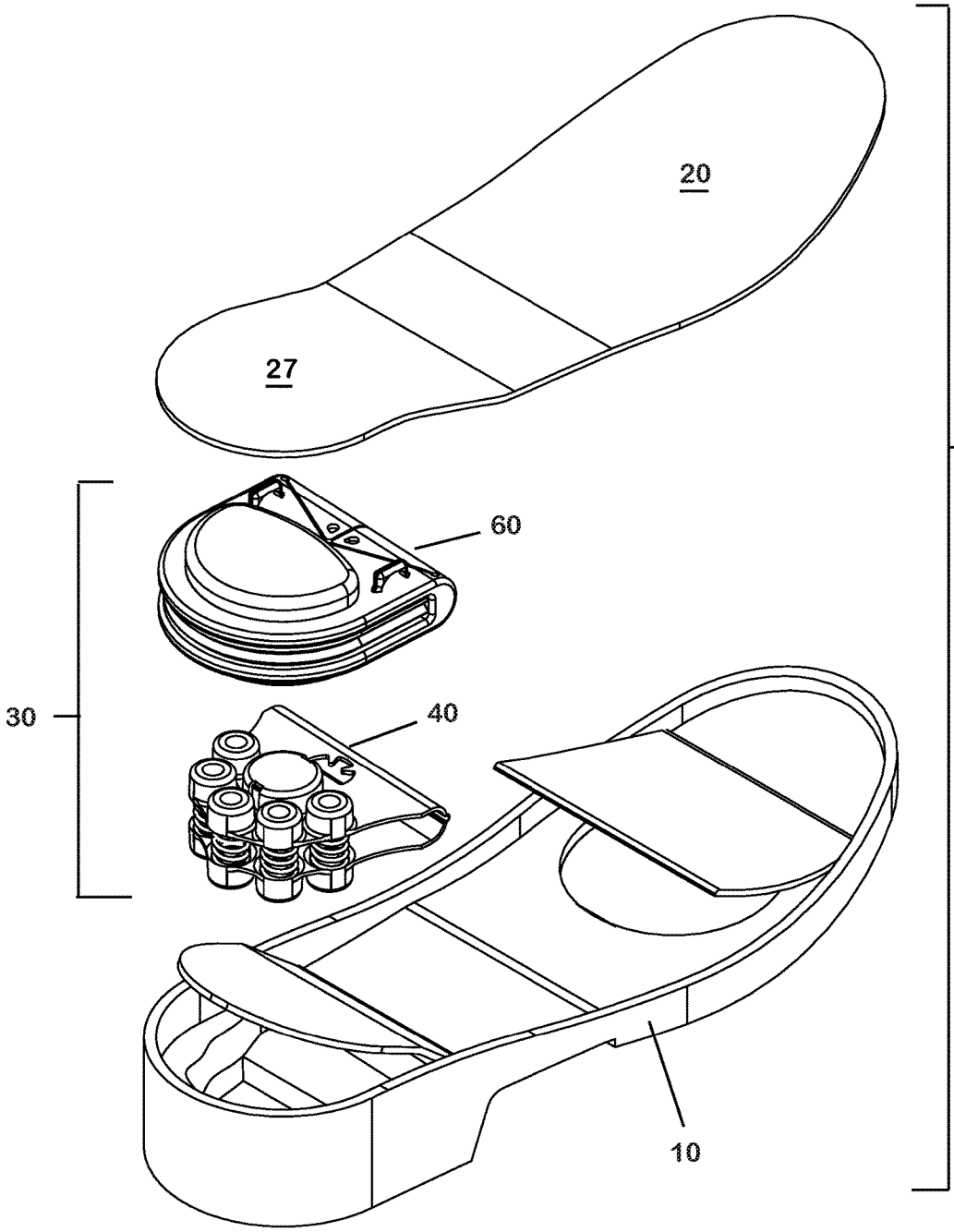
FIG. 1 is an exploded perspective view of a first embodiment of shock absorbing footwear embodying the invention.
Figure 2:
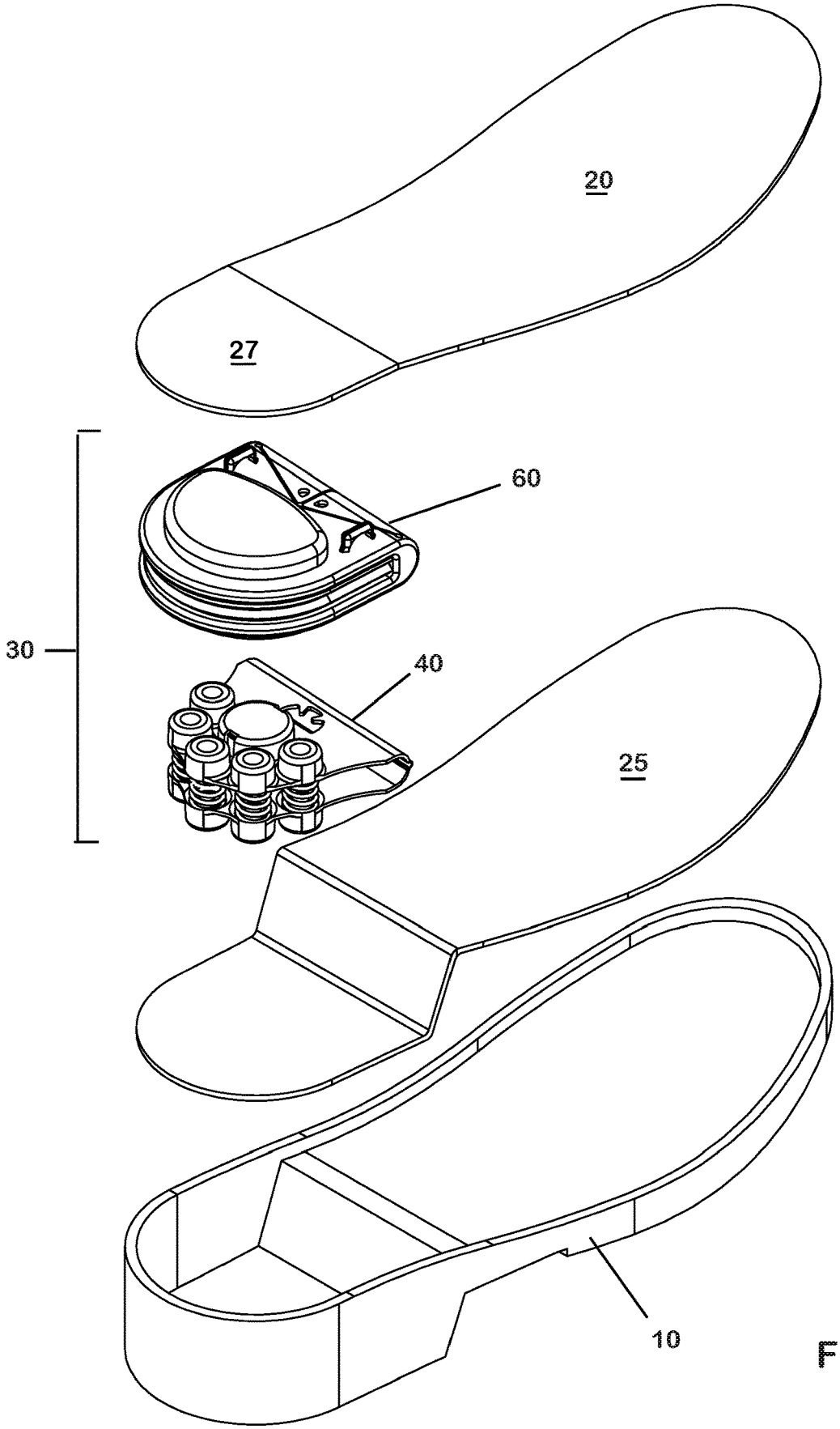
FIG. 2 is a similar view of a second embodiment of the invention.

As shown in FIGS. 1 and 2, which depict two embodiments of the invention, shock absorbing footwear embodying the invention includes an outsole 10, an insole 20, and an insert assembly 30.

The outsole 10 is preferably made of rubber, EVA, composite or polyurethane.

It has an open heel cavity or a similar cavity beneath the ball of the foot, approximately as wide as the heel or ball, 2.5" for example. FIG. 2 shows the heel cavity only, as an example. The reader will understand that the principles illustrated can easily be adapted to an insert placed beneath the ball of the foot (as suggested in FIG. 1) rather than—or in addition to—at the heel location.

The heel cavity has an opening on one side, e.g., toward to the arch or heel, approximately 3.0" wide, for receiving the insert assembly.

The outsole has a perimeter bead made of rubber, eva, composite or polyurethane. Alternatively, it may have multiple beads (upper and lower) to allow the insert to be manually pressed in the cavity while also allowing for easy removal and replacement.

The footwear preferably also includes, between the insole and outsole, a midsole or footbed 25 made of modified cardboard or other suitable stiff material. The insole (FIG. 1)

or the footbed (FIG. 2) has a hinged or flexible portion 27 which can be peeled back to allow access to the insert for removal or replacement.

Figure 4:
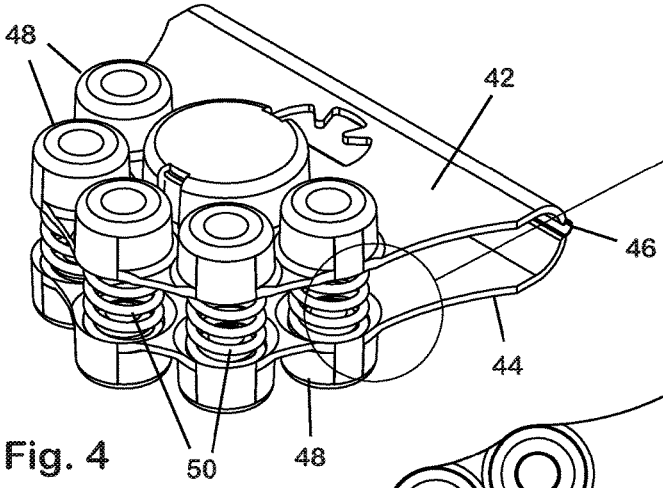
FIG. 4 is a view of a spring insert assembly shown in FIGS. 1 and 2.
Figure 5:
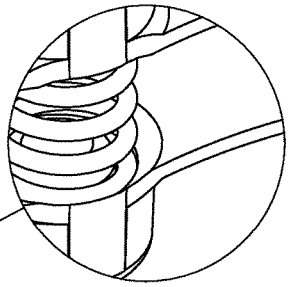
FIG. 5 is an enlargement of the portion of FIG. 4 indicated by a circle.
Figure 7:
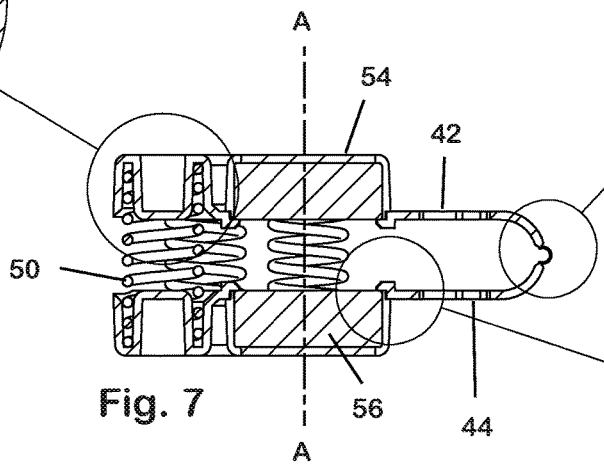
FIG. 7 is a sectional view taken on the vertical center plane 7-7 in FIG. 6.
Figure 9:
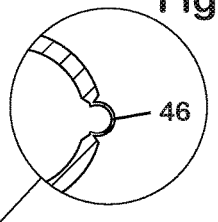
Figure 10:
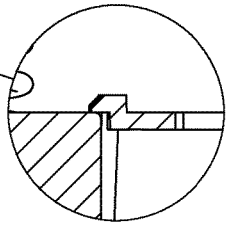
Figures 11, 12:
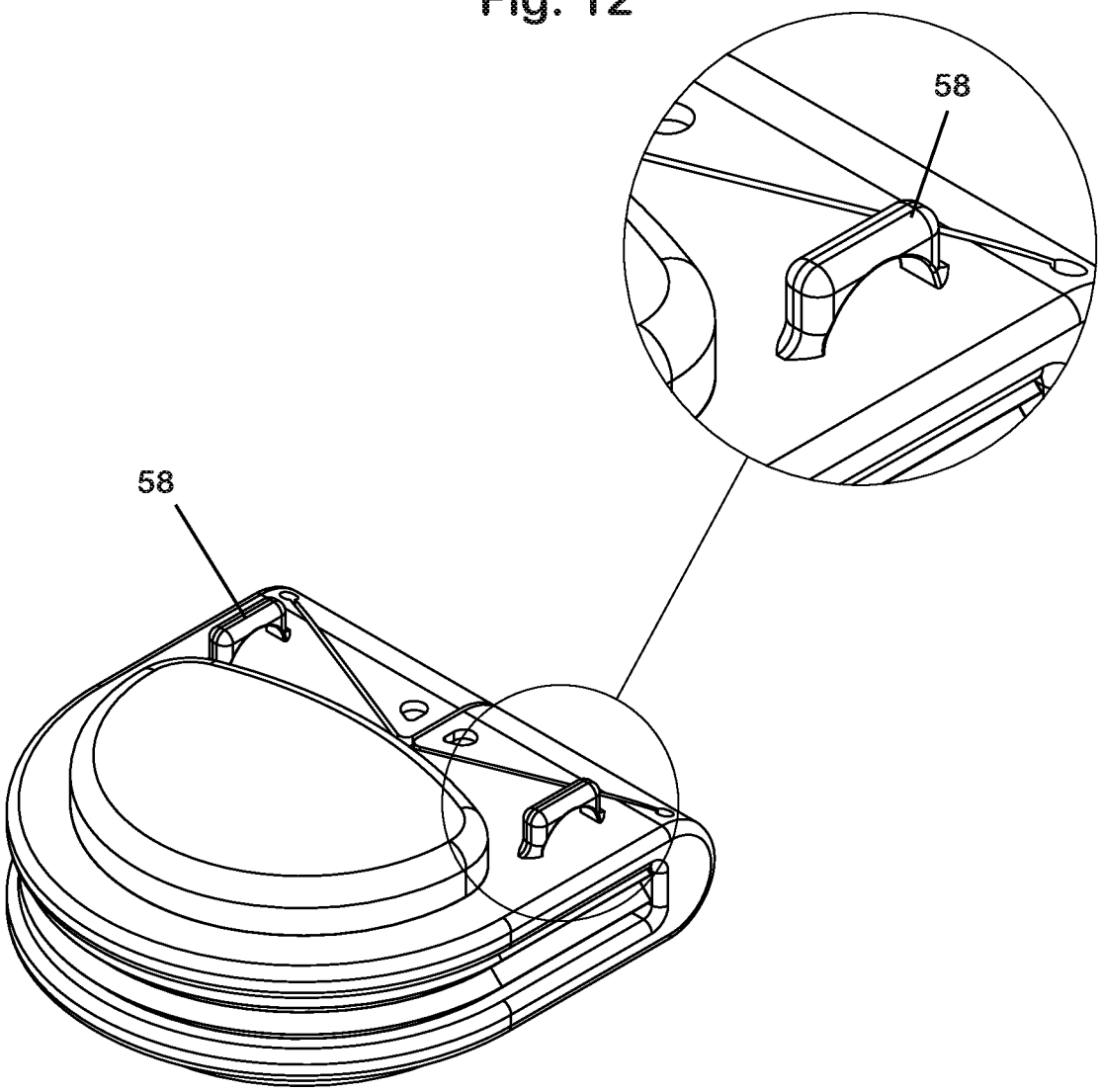
FIG. 11 is a perspective view of a portion of a debris shield shown in FIGS. 1 and 2.
FIG. 12 is an enlargement of the portion of FIG. 11 indicated by a circle.
Figure 13:
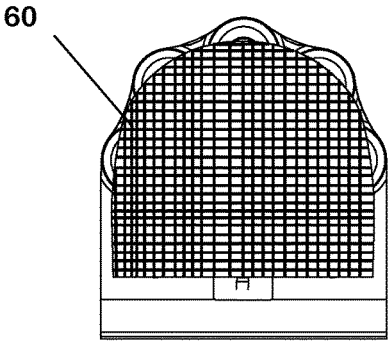
FIGS. 13-16 illustrate a modified form of the invention, which includes an electrical power generating and battery storage system.
Figure 14:
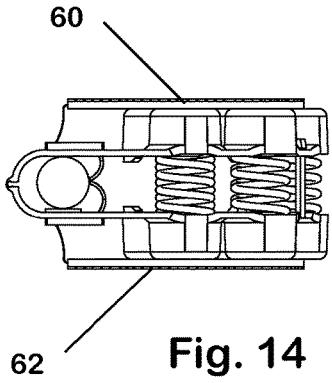

The insert assembly 30 includes a spring assembly 40 contained within a protective debris shield 60. The spring assembly, best seen in FIGS. 4 and 7, includes a plate which has upper and lower portions 42, 44 joined along one edge by a living hinge 46; that is, the upper and lower plates are one continuous piece of material. The living hinge provides a preferred line of flexure between the upper and lower portions and allows the insert to be closed around the coil springs and magnets described below. The hinge and the upper and lower plates are preferably a single piece U-shaped molded part made of nylon or other suitable polymer.

Each of the upper and lower plate portions 42, 44 is provided with a plurality of (preferably five or more) cup-shaped seats 48, each designed to receive one end of a respective compression coil spring 50, Each seat on the upper portion is aligned with a counterpart seat on the lower portion, along a longitudinal axis of the spring. Each seat has spaced walls 52, 54 defining an annular volume for securely holding the end of one of the springs.

The spring seats 48 have beveled tops to prevent spring rub. The bottoms of the seats have protruding ribs that allow the spring to snap in, but hold the springs in place thereafter.

Exemplary dimensions for each coil spring are 1.25" length by 0.50" diameter. The springs are preferably made of stainless steel; however, it should be understood that the choice of materials and exact dimensions may be adjusted to suit a particular situation. Furthermore, other types of mechanical springs, such as wave springs or Belleville springs, might be used instead of coil springs. The claims below use the generic term "mechanical compression springs" to cover all such alternatives.

The seats 48 are preferably molded integrally with the plate portions 42, 44, but they could alternatively be made as separate pieces.

Figure 6:
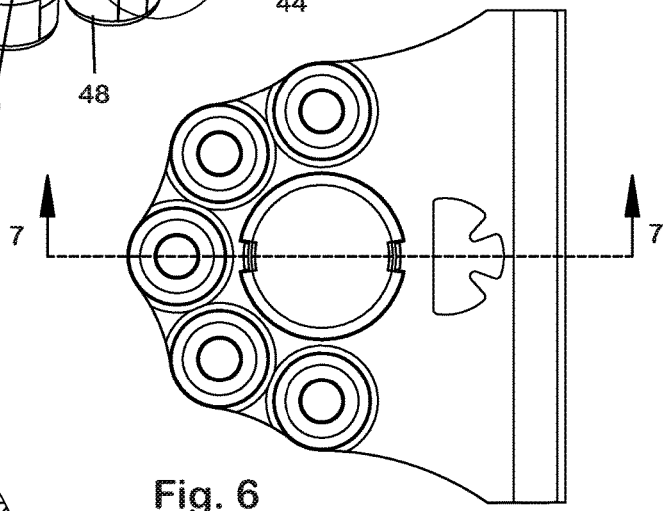
FIG. 6 is a top plan view of the insert assembly.
Figure 8:
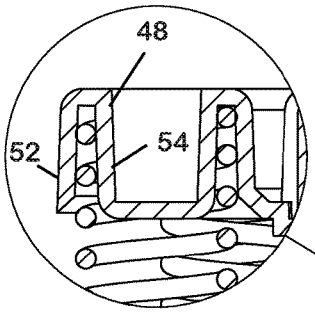
FIGS. 8, 9 and 10 are enlargements of the portions indicated in FIG. 7 by respective circles.

Upper and lower magnet canisters 55 are also formed in the plate, amid the coil spring seats 48. The axis A-A (FIG. 7) of each canister lies on the vertical center plane 7-7 (FIG. 6) of the insert. The coil spring seats are arranged around the canisters, preferably at a uniform radial distance from the axis A-A. The insert preferably has snap-in feature to hold the magnet canisters in place.

The preferred magnets 56 are two opposing thick nickel-coated rare earth permanent magnets of 35 MGOe (megagauss oersteds) or greater, Exemplary dimensions of each magnet are 1.0" dia.×0.350".

It is preferred that the magnet spring and coil spring arrangement be able to support a load in the range of 100-600 pounds without coil binding.

Figure 3:
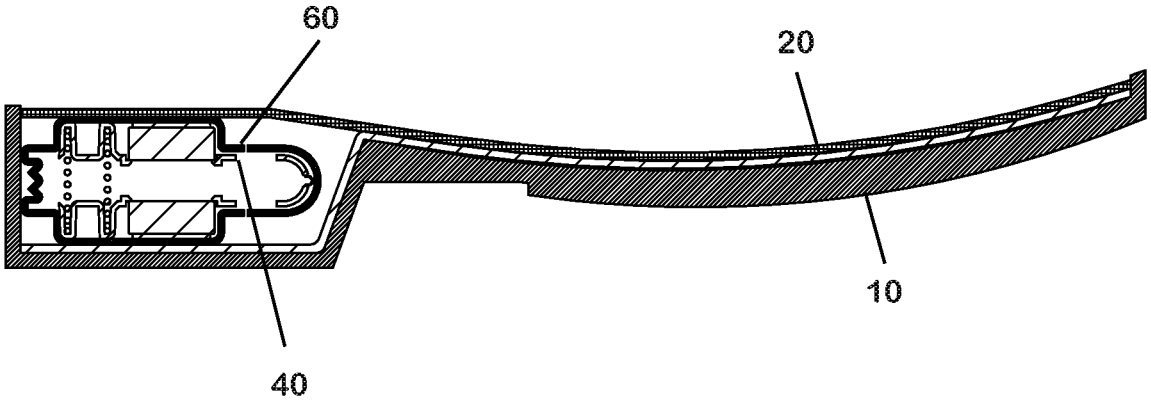
FIG. 3 is an unexploded sectional view of the second embodiment, taken on a vertical longitudinal plane.

Before being installed in the outsole, the spring insert is placed within a debris shield 60 (FIGS. 1-3) which provides some structural support and protects the springs and magnets from the elements (water, dirt, abrasive particles). The debris shield is a rubber or elastomeric polymer cover for the spring assembly; it is open on one end to receive the spring assembly.

The debris shield preferably has a pair of pull tabs 58 that the user can grasp when removing the spring insert from the envelope.

The insert assembly, normally securely seated in the recess in the outsole, can be quickly removed, for example when one desires to replace the insert with another having different spring characteristics, or to rebuild the inert by replacing the mechanical springs or the magnetic spring with parts having different spring rates of other characteristics. For example, the coil spring rates can be adjusted higher or lower around the perimeter of the insert. All the coil springs may have the same spring rate, or springs of different rates may be used to control pronation and supination for a particular wearer.

FIGS. 13-16 shows a modified form of the invention, further including an electrical power generating and storage system.

A heel insert utilizing two opposing 35 MGOe or greater permanent magnets 56 (FIG. 7) further includes copper wire windings 60, 62 running from the top (12 o'clock) of the permanent magnet to the bottom of the permanent magnet (six o'clock). The windings are situated on the flat faces of the permanent magnets, oriented 90° to the magnetic field between the permanent magnets. The windings are placed on a board in multiple layers, running both north-south and east-west.

The number of windings determines the DC voltage output. As magnets move toward and away from one another in use, movement of the wire through the magnetic field induces alternating current in the windings. The wire windings lead to energy converting means such as an energy harvesting chip 64 which converts the alternating current to direct current.

The preferred chip 64 is a low voltage device such as Texas Instrument BQ25570 Ultra Low Power Harvester Power Management IC. This device, which is available from Texas Instruments, Dallas, Tex., modulates and amplifies current induced in the winding. The BQ25570 chip can start at extremely low voltage levels (~330 mV) and can continue to harvest energy all the way down to 100 mV.

Figure 15:
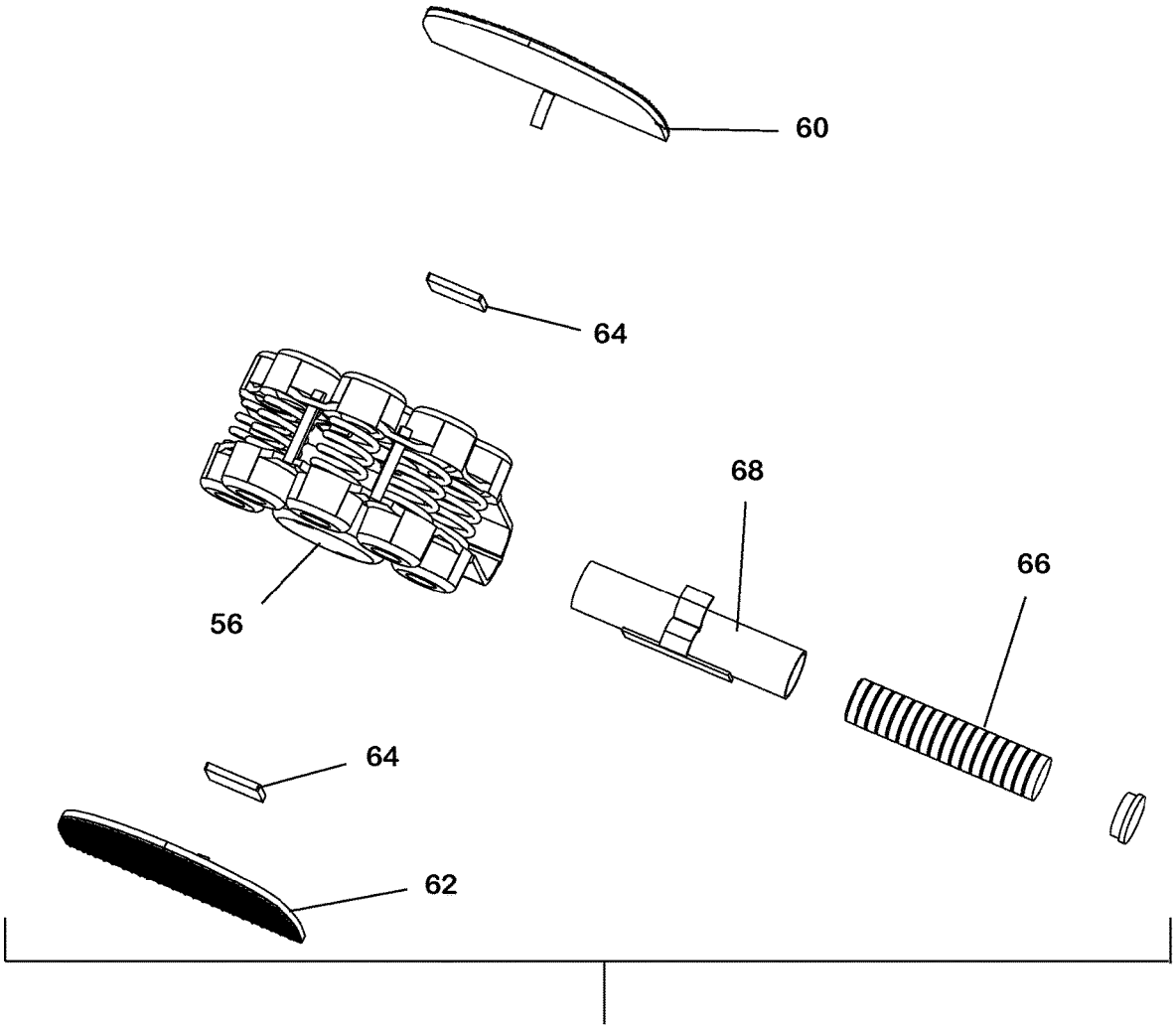
Figure 16:
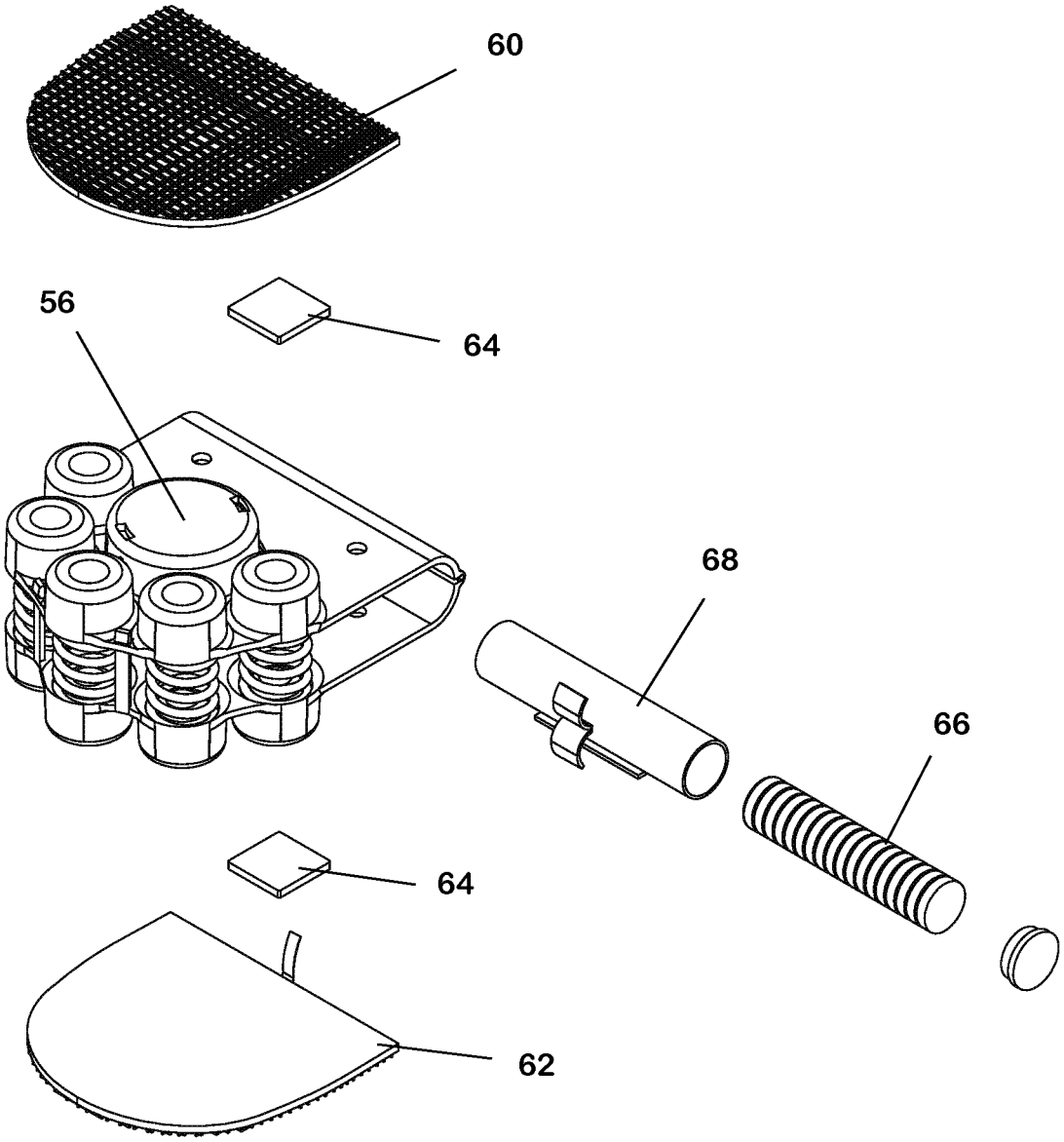

The generated current can be used immediately or saved in a storage device 60, which may be a rechargeable battery or one or more supercapacitors. Presently, rechargeable lithium batteries are preferred as the most economical storage device. A stack of lithium coin batteries is illustrated in FIGS. 15 and 16; other types of rechargeable batteries could be substituted. The batteries are placed in a container 68.

The windings may be made of copper or silver wire. Silver may be a better source, but the cost will be more. A copper winding can also capture the energy and would be a cheaper alternative.

The chip should not be positioned in the magnetic field of the capture device, which should be separate or isolated on one part of the board. If the BQ25570 is placed in the magnetic field, there may be issues with noise. Preferably, therefore, a circuit board with the BQ25570 on it is mounted separate from the collection device.

The BQ25570 is preferably connected directly to the output of the winding, but one should make sure that the voltage and current waveforms as the output of the winding are proper for the device. It may be necessary to use transorbs or the like to make sure that the voltage does not exceed the maximum voltage level of the BQ25570.

Inasmuch as the invention is subject to variations and modifications, the foregoing description should be understood to be merely a preferred form of the invention defined by the claims below.

I claim:

1. A modular article of footwear comprising:

an outsole, an inner sole, and a removable shock absorbing insert disposed in a cavity between the outsole and the inner sole, said shock absorbing insert comprising:

a spring carrier having upper and lower plate portions, each of said plate portions respectively having a plurality mating seats for receiving respective ends of a plurality of mechanical compression springs, and the upper and the lower plate portions being connected with one another by a hinge to facilitate flexing of the upper and lower plate portions relative to one another, at least one pair of tabs being provided on a debris shield positioned over the spring carrier, the plurality of mechanical compression springs, each extending between a pair of mating seats of said upper and lower plate portions and being captured therebetween, and the plurality of mating seats arranged at a uniform radial distance around a magnetic spring, and said magnetic spring comprising a pair of permanent magnets of opposed polarity.

2. The modular article of footwear of claim 1, wherein each of the plurality of mechanical compression springs is a coil spring and each of the mating seats has a double wall defining an annular volume for securely holding an end of a respective coil spring.

3. The modular article of footwear of claim 1, wherein the debris shield holds the spring carrier in the footwear, whereby the spring carrier can be swapped for another spring carrier having different spring characteristics for users of different weights.

4. The modular article of footwear of claim 1, wherein the upper and lower plate portions of the spring carriers are both formed from a continuous piece of material and integrally interconnected with one another by the hinge, and the hinge is a living hinge.

5. The modular article of footwear of claim 1, wherein the pair of mating seats are molded integrally with and as part of the spring carrier.

6. The modular article of footwear of claim 1, wherein the shock absorbing insert further comprises upper and lower magnet canisters formed in the upper and lower plate portions, and the magnetic spring being received by the upper and lower magnet canisters.

7. The modular article of footwear of claim 6, wherein the upper and lower magnet canisters are aligned on an axis which lies on a vertical center plane of the shock absorbing insert.

8. The modular article of footwear of claim 7, wherein the plurality of mating seats are uniformly arranged around said axis.

9. The modular article of footwear of claim 1, wherein said magnets are rare earth permanent magnets having a magnetic strength of at least 35 MGOe.

10. The modular article of footwear of claim 1, wherein the spring carrier is enclosed within and surrounded by the debris shield to protect the plurality of mechanical compression springs and the pair of permanent magnets from water, dirt and abrasive particles.

11. The modular article of footwear of claim 10, wherein the at least one pair of tabs allows a user to grasp the shock absorbing insert to facilitate removal or replacement of the spring carrier from the debris shield.

12. The modular insert assembly of claim 1, wherein the plurality of mechanical compression springs are selected to as to together support a load in the range of 100-600 pounds without binding.

13. The modular insert assembly of claim 1, wherein the plurality of mechanical compression springs surround the pair of permanent magnets such that the pair of permanent magnets are located between the hinge and the mechanical compression springs.

14. The modular insert assembly of claim 1, wherein a spacing of the upper plate portion from the lower plate portion is less than a length of each of the plurality of mechanical compression springs.

15. The modular insert assembly of claim 1, wherein each of the plurality of mating seats, formed in the upper plate portion, captively surround and retain one end of a respective mechanical compression spring while each of the plurality of mating seats, formed in the lower plate portion, captively surround and retain an opposite end of the respective mechanical compression spring.

16. A modular article of footwear comprising:

an outsole, an inner sole, and a removable shock absorbing insert disposed in a cavity between the outsole and the inner sole, said shock absorbing insert comprising:

a spring carrier having upper and lower plate portions, each of said plate portions respectively having a plurality mating seats for receiving respective ends of a plurality of mechanical compression springs, and the upper and the lower plate portions being connected with one another by a hinge to facilitate flexing of the upper and lower plate portions relative to one another, at least one pair of tabs being provided on a debris shield positioned over the spring carrier, the plurality of mechanical compression springs, each extending between a pair of mating seats of said upper and lower plate portions and being captured therebetween, the plurality of mating seats arranged at a uniform radial distance around a magnetic spring, and said magnetic spring comprising a pair of permanent magnets of opposed polarity, and a spacing of the upper plate portion from the lower plate portion is less than a length of each of the plurality of mechanical compression springs.

* * * * *